US007969082B2

(12) United States Patent
Takada et al.

(10) Patent No.: US 7,969,082 B2
(45) Date of Patent: Jun. 28, 2011

(54) ELECTRON BEAM APPARATUS

(75) Inventors: Hiroko Takada, Isehara (JP); Jun Iba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

(21) Appl. No.: 12/545,432

(22) Filed: Aug. 21, 2009

(65) Prior Publication Data

US 2010/0060137 A1 Mar. 11, 2010

(30) Foreign Application Priority Data

Sep. 9, 2008 (JP) ..... 2008-231026

(51) Int. Cl.
*H01J 1/62* (2006.01)

(52) U.S. Cl. ..... 313/448; 313/495

(58) Field of Classification Search ..... 313/294, 313/448, 449; 427/78
See application file for complete search history.

(56) References Cited

U.S. PATENT DOCUMENTS

| | | | | |
|---|---|---|---|---|
| 6,179,678 | B1 * | 1/2001 | Kishi et al. | 445/24 |
| 7,077,716 | B2 * | 7/2006 | Mizuno et al. | 445/24 |
| 7,382,088 | B2 | 6/2008 | Azuma et al. | |
| 7,427,826 | B2 | 9/2008 | Iba et al. | |
| 7,507,134 | B2 | 3/2009 | Iba et al. | |
| 7,611,394 | B2 * | 11/2009 | Kawate et al. | 445/49 |
| 7,679,278 | B2 * | 3/2010 | Nukanobu et al. | 313/495 |
| 7,843,118 | B2 * | 11/2010 | Nukanobu et al. | 313/310 |
| 2001/0019247 | A1 | 9/2001 | Tsukamoto | |
| 2003/0082981 | A1 * | 5/2003 | Takegami et al. | 445/6 |
| 2008/0238287 | A1 * | 10/2008 | Iba et al. | 313/458 |
| 2008/0238288 | A1 | 10/2008 | Iba et al. | |
| 2008/0309592 | A1 | 12/2008 | Ohashi et al. | |
| 2009/0058252 | A1 | 3/2009 | Takada et al. | |
| 2009/0072697 | A1 | 3/2009 | Hiroki et al. | |

FOREIGN PATENT DOCUMENTS

| | | |
|---|---|---|
| JP | 9-330646 A | 12/1997 |
| JP | 2001-167693 | 6/2001 |
| JP | 2001-229809 A | 8/2001 |

* cited by examiner

*Primary Examiner* — Anne M Hines
*Assistant Examiner* — Jacob Stern
(74) *Attorney, Agent, or Firm* — Fitzpatrick, Cella, Harper & Scinto

(57) ABSTRACT

It aims to improve electron emission efficiency in an electron beam apparatus which includes laminated electron-emitting devices. To achieve this, there are provided an insulating member which has a concave portion on its surface, a cathode which is positioned astride a side surface of the insulating member and an inner surface of the concave portion, a gate which is positioned opposite to the cathode, and a protruding portion which is formed on the gate. In this constitution, the low potential surface of the cathode which is positioned inside the concave portion is inclined to the side of the gate from the entrance toward the interior of the concave portion.

1 Claim, 14 Drawing Sheets

ELECTRON BEAM APPARATUS

BACKGROUND OF THE INVENTION

1. Field of the Invention

The present invention relates to an electron beam apparatus, to be used for a flat panel display, which has electron-emitting devices of emitting electrons.

2. Description of the Related Art

Conventionally, there are electron-emitting devices in which a sizable percentage of electrons emitted from cathodes are collided with opposite gates, the collided electrons are scattered, and then the scattered electrons are extracted as the electrons. As a device of emitting electrons in such a manner as described above, a surface conduction electron-emitting device and a laminated electron-emitting device have been known. For example, Japanese Patent Application Laid-Open No. H09-330646 and Japanese Patent Application Laid-Open No. 2001-229809 (corresponding to United States Patent Application Publication No. 2001/0019247) respectively disclose laminated electron-emitting devices.

However, in regard to the electron-emitting devices respectively disclosed in Japanese Patent Application Laid-Open Nos. H09-330646 and 2001-229809, further improvement in respect of electron emission efficiency is desired.

SUMMARY OF THE INVENTION

The present invention aims to provide an electron beam apparatus which includes high-efficiency electron-emitting devices.

According to an aspect of the present invention, there is provided an electron beam apparatus which comprises: an insulating member which has a concave portion on its surface; a cathode which is positioned astride an outer surface of the insulating member and an inner surface of the concave portion; a gate which is positioned opposite to the cathode on the outer surface of the insulating member; and an anode which is positioned opposite to the cathode so that the gate is disposed between the anode and the cathode, wherein an angle θ between a surface of a portion of the cathode which is positioned on the inner surface of the concave portion and a virtual plane of which a normal line is a line connecting respective aperture side ends of the cathode and the gate in a region of the concave portion that the cathode and the gate are mutually opposed satisfies an expression (1)

$$\theta \geqq 15\times(h2/d)^{0.5}+(230\times Vf^{-0.6}-35)$$

$$(0°<\theta<90°) \quad (1)$$

where d: a shortest distance between the cathode and the gate in the region of the concave portion that the cathode and the gate are mutually opposed [nm], h2: a height of a side member of the gate in a direction parallel with that of the shortest distance d [nm], and Vf: a driving voltage [V].

According to the present invention, since the force in the direction drawing apart from the gate at the time of electron emission comes to be large, the electrons easily fly far away, and thus the electrons are not absorbed by the gate, whereby it is possible to obtain high electron emission efficiency.

Further features of the present invention will become apparent from the following description of the exemplary embodiment with reference to the attached drawings.

DESCRIPTION OF THE EMBODIMENTS

Hereinafter, the exemplary embodiment of the present invention will be described with reference to the attached drawings. However, with respect to the dimension, the material and the shape of constitutional parts and the relative arrangement thereof described in the embodiment, a scope of the present invention is not limited to only these factors as long as a specific description is not given.

An electron beam apparatus of the present invention has an electron-emitting device for emitting electrons and an anode to which the electrons emitted from the electron-emitting device reach, and an image displaying apparatus is constituted by further arranging light-emitting members such as phosphors on outer sides of the anodes.

Figure 1A:
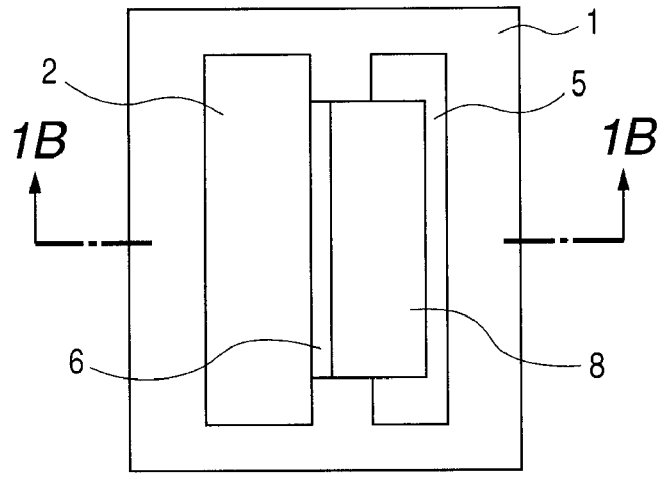
FIGS. 1A and 1B are views schematically illustrating the constitution of an electron-emitting device in an electron beam apparatus according to the embodiment of the present invention.
Figure 1B:
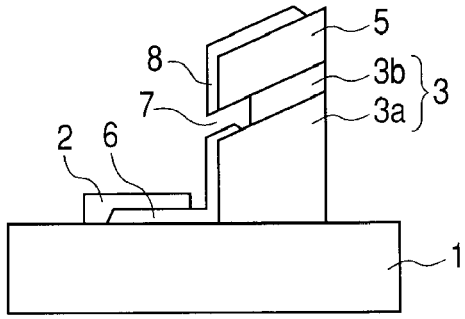

FIGS. 1A and 1B are views schematically illustrating the constitution of the electron-emitting device in the electron beam apparatus according to the embodiment of the present invention. More specifically, FIG. 1A is the schematic plan view, and FIG. 1B is the schematic cross-sectional view taken along the line 1B-1B in FIG. 1A. In FIGS. 1A and 1B, a substrate 1, an electrode 2, an insulating member 3 composed of insulating layers 3*a* and 3*b*, a gate 5, a cathode 6 formed by the conductive material to be electrically connected with the electrode 2 and a concave portion 7 provided on the insulating member 3 are illustrated. The cathode 6 is positioned astride a side wall surface, which is an outer surface of the insulating member 3, and an inner surface of the concave portion 7. A protruding portion 8, which is consisted of the same material as that of the cathode 6, is provided on the gate 5. Moreover, the protruding portion 8 functions as a gate together with the gate 5. In this constitution, a surface of the cathode 6 is set to a low-potential side of the voltage of extracting the electrons and the protruding portion 8 is set to a high-potential side. In the present example, the protruding portion 8 is also a part of the gate and it is also possible to call a gate by combining the protruding portion 8 with the gate 5. However, in the present example, it is called a high-potential side structure by combining the protruding portion 8 with the gate 5 for convenience.

Figure 2:
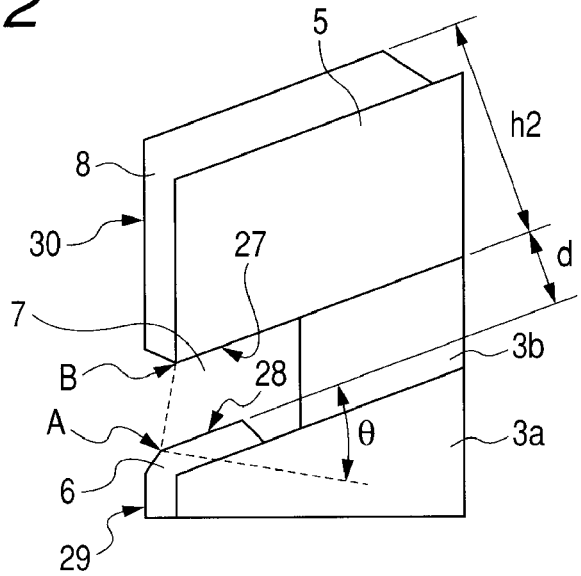
FIG. 2 is a schematic cross-sectional view of enlarging a concave portion of the electron-emitting device and the periphery thereof illustrated in FIG. 1B.

FIG. 2 is view of enlarging the concave portion 7 and the periphery thereof illustrated in FIG. 1B. As illustrated in FIG. 2, the concave portion 7 is constituted by at least a low-potential surface 28, a high-potential surface 27 and a side surface of the insulating layer 3*b*, and the low-potential surface 28 and the high-potential surface 27 correspond to such regions kept in that the cathode 6 and the high-potential side structure are opposite each other. Here, an aperture side end of the concave portion 7 of the high-potential surface 27 of the high-potential side structure is assumed to be denoted as B and an aperture side end of the concave portion 7 of the low-potential surface 28 of the cathode 6 is assumed to be denoted as A. In FIG. 2, although the high-potential surface 27 is limited within the gate 5, in the present invention, there is also a case that the high-potential surface 27 extends to the protruding portion 8 side and the end B is set on the protruding portion 8.

The low-potential surface 28 is such a surface of defining the low potential within the concave portion 7. The high-potential surface 27 is such a surface of defining the high potential within the concave portion 7. In a case that the low-potential surface 28 or the high-potential surface 27 is a convex-concave surface, a curved surface obtained by connecting the respective uppermost surfaces of the convex-concave portions is treated as the low-potential surface 28 or the high-potential surface 27. Generally, a level of unevenness by the convex-concave portions is in a range of about several nanometers (nm).

In FIG. 2, the shortest distance between the low-potential surface 28 and the high-potential surface 27 is treated as a gap d in the concave portion 7. Regarding the gap d in the concave portion 7, in a case that there are projections on the low-potential surface 28 or the high-potential surface 27, a distance when including the projections is treated as the shortest distance. The height of a gate side member in the direction parallel to the gap d is denoted by reference symbol 2*h*, which corresponds to the height of the high-potential side structure including the gate 5 and the protruding portion 8 in the present example. The high-potential side member may be potential defined as in the present example or may not be potential defined like the insulator.

A side surface 29 of the cathode 6 indicates such a surface where the potential is defined along the low-potential side of an outer surface of the insulating member 3 (that is, an outer surface of the insulating layer 3*a* in the present example) at the outside of the concave portion 7. Moreover, a side surface 30 of the protruding portion 8 indicates such a surface where the potential is defined along the high-potential side structure (the gate 5 and the protruding portion 8) at the outside of the concave portion 7 within a range indicated by the height 2*h*. In a case that the side surface 29 at the low-potential side or the side surface 30 at the high-potential side has a convex-concave portions, a curved surface obtained by connecting the respective uppermost surfaces of the convex-concave portions is treated as the side surface 29 of a low-potential surface or the side surface 30 of a high-potential surface. Generally, a level of unevenness by the convex-concave portions is in a range of about several nanometers (nm). In FIG. 2, it is assumed that an inclined region connected between the side surface 30 at the high-potential side and the high-potential surface 27 is included in the side surface 30 and an inclined region connected between the side surface 29 at the low-potential side and the low-potential surface 28 is included in the side surface 29. Therefore, a point A is an intersection point of the low-potential surface 28 of the cathode 6 and the side surface 29, and a point B is an intersection point of the high-potential surface 27 of the high-potential side structure and the side surface 30.

A line segment AB of connecting the point A with the point B is treated as a gateway of the concave portion 7. In the present invention, it is constituted that the low-potential surface 28 becomes to be inclined to the high-potential side for a virtual plane to which the line segment AB serves as a normal line, when the low-potential surface 28 is more deeply advanced to the inside from the gateway of the concave portion 7. In addition, an angle (inclined angle of the low-potential surface 28) θ formed between the low-potential surface 28 and the above-mentioned virtual plane is in a range of $0° < \theta < 90°$.

Figure 3:
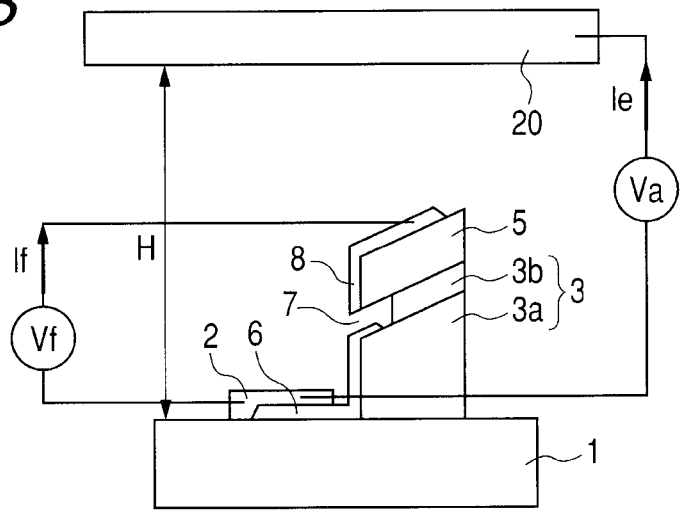
FIG. 3 is a view schematically illustrating the constitution of the electron beam apparatus according to the embodiment of the present invention.

FIG. 3 indicates the power supply arrangement of the electron beam apparatus of the present invention having the electron-emitting device illustrated in FIGS. 1A and 1B. Here, a voltage Vf is applied between the protruding portion 8 and the cathode 6. A device current If flows between the protruding portion 8 and the cathode 6. A voltage Va is applied between the cathode 6 and an anode 20. An electron emission current Ie flows between the cathode 6 and the anode 20. As illustrated in FIG. 3, in the electron beam apparatus of the present invention, the anode 20 is arranged on a position opposite to the cathode 6 through the gate 5 having a predetermined distance (distance H from the substrate 1) from the cathode 5.

Here, an electron emission efficiency (i) is generally given by an expression $\eta = Ie/(If+Ie)$ by using the device current (If) to be detected when the voltage was applied to the device and the electron emission current (Ie) to be extracted in a vacuum space.

Next, an effect of realizing the high efficiency of electron emission according to the constitution of the present invention will be described by using FIGS. 4A and 4B.

The improvement of the electron emission efficiency can be realized by such the constitution, where the scattering number of electrons at the high-potential side structure is decreased. A fact that the decrease of the scattering number becomes to realize the high efficiency depends on the following reason.

Electrons are sometimes absorbed in the gate 5 and the protruding portion 8 which are the conductive members when the electrons are scattered. Even if the electrons are not absorbed by only one scattering, the energy of electrons is gradually lost by repeating scattering. As a result, the electrons are sometimes absorbed. That is, the electrons absorbed in the conductive members are reduced by decreasing the number of scattering, and the more electrons can be reached the anode 20.

Figure 4A:
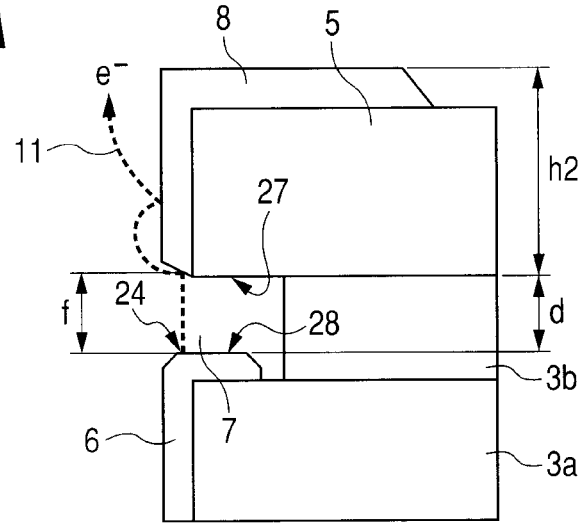
FIGS. 4A and 4B are explanatory views in realizing the high efficiency of electron emission according to the constitution of the present invention.

FIG. 4A indicates a cross-sectional view of an electron-emitting device constituted that the low-potential surface 28 in the concave portion 7 is set to become parallel to a surface of the substrate 1. FIG. 4B indicates a cross-sectional view of the electron-emitting device of the present invention. Broken lines 11 and 12 respectively indicate an example of an electron trajectory of an electron emitted in each of the electron-emitting devices. Reference symbol f denotes the flying distance of an electron from a position that the electron is emitted from the cathode 6 to a position that the electron is firstly scattered. Enlarged views of the peripheries of the concave portion 7 in FIGS. 4A and 4B are illustrated in FIGS. 5A and 5B. In FIGS. 5A and 5B, each of broken lines 22 is an equipotential line, and each of arrowed lines 25 indicates the direction of force to be applied to an electron at an electron emission position 24.

As illustrated in FIG. 4A and FIG. 5A, in a case that the low-potential surface 28 is parallel to the surface of the substrate 1, the equipotential line 22 at the electron emission position 24 is nearly parallel to the virtual plane to which the line segment AB serves as the normal line. However, as illustrated in FIG. 4B and FIG. 5B, when the constitution of the present invention is used, the equipotential line 22 at the electron emission position 24 has the angle of an inclined angle θ for the virtual plane to which the line segment AB serves as the normal line. Since the electron is subjected to the force of which the direction is vertical to the equipotential line 22, the direction of the force to be applied to the electron at the electron emission position 24 becomes to be differed according to the inclined angle θ of the low-potential surface 28.

As indicated by the arrowed line 25 in FIG. 5A, in this constitution, since the electron is intensively subjected to the force attracted to the gate 5 or the protruding portion 8 at the electron emission position 24, the flying distance f becomes a short distance. Therefore, the electron reaches the anode 20 after repeating several times of scattering (multiple scattering) at the gate 5 or the protruding portion 8.

However, as indicated by the arrowed line 25 in FIG. 5B, in the constitution of the present invention, the force affecting to the direction of increasing distance from the gate 5 or the protruding portion 8 becomes larger at the electron emission position 24, and the flying distance f becomes a large distance. Therefore, an effect of realizing the high efficiency can be obtained by a fact that the electron reaches the anode 20 under the situation that the scattering number of the electron at the gate 5 and the protruding portion 8 decreases or the electron is not scattered at the gate 5 and the protruding portion 8.

That is, the electron emission efficiency can be improved by inclining the low-potential surface 28 to the high-potential side when it is more deeply advanced to the inside from the gateway of the concave portion 7 as in the present invention.

Figure 4B:
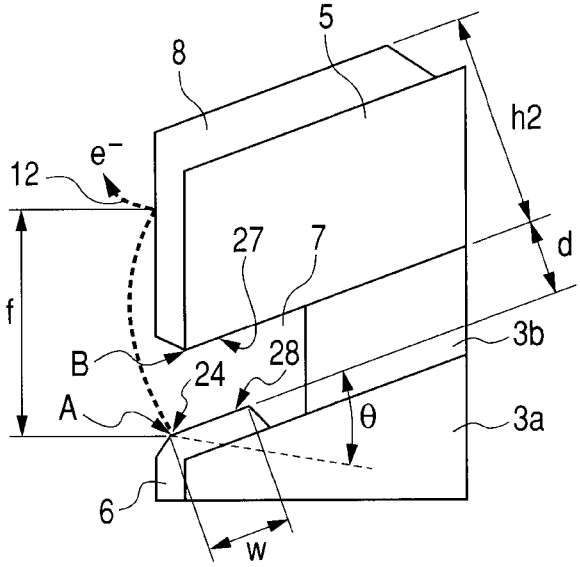
Figure 5A:
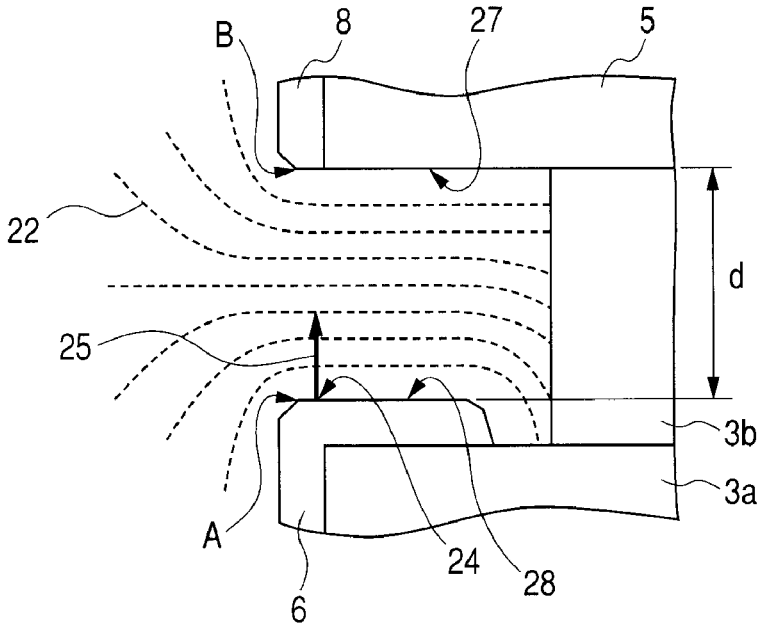
FIGS. 5A and 5B are explanatory views in realizing the high efficiency of electron emission according to the constitution of the present invention.
Figure 5B:
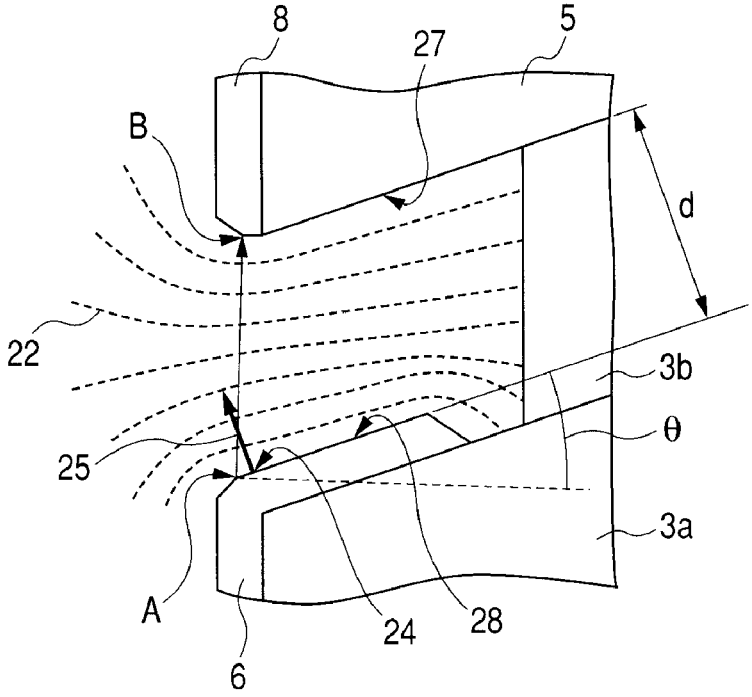

Reference symbol w in FIG. 4B denotes the distance of defining the potential from the gateway to the inside direction of the low-potential surface 28 in the concave portion 7. To realize the high efficiency, the equipotential line 22 peripheral to the electron emission position 24 must have the inclined angle θ for the virtual plane to which the line segment AB serves as the normal line. For this purpose, the distance w needs a certain level of length. Preferably, the distance W is equal to or longer than 10 nm.

Furthermore, in the present invention, a critical effect can be obtained by the following conditional expression.

In the constitution of the present invention, the characteristic is mainly determined by the inclined angle θ, the voltage Vf, the gap d in the concave portion 7 and the height h2 of the gate side member. Due to the above-mentioned reason, when the inclined angle θ becomes a larger angle, the electron emitting direction is varied, and the flying distance f becomes a longer distance. As for the voltage Vf and the gap d, the electron energy is increased in accordance with the increasing of the voltage Vf or the decreasing of the gap d, and the flying distance f becomes a longer distance.

When the height h2 becomes to be decreased, the thickness of a high-potential side laminated body becomes a thin thickness, and since the electrons become hard to be collided with the high-potential side structure, the number of scattering decreases. Due to a fact that the height h2 becomes less than the flying distance f, which is from a position that the electron is emitted to a position that the electron is firstly scattered, that is, becomes to a level of h2<f, the electron reaches the anode 20 without scattering. In addition, the critical high efficiency effect can be obtained by constituting that all the electrons reach the anode without scattering.

In the present constitution, as a result of conducting a detailed investigation of the behavior of scattering, the inclined angle θ can be expressed by a function of using the voltage Vf, the gap d and the height h2. That is, it becomes apparent that the efficiency is critically improved according to a shape of the periphery of the electron emitting portion and an effect of the driving condition and there exists the condition where the electron scattering becomes a level of 0% and the electron emission efficiency becomes a level of 100% (If=0).

Figure 6:
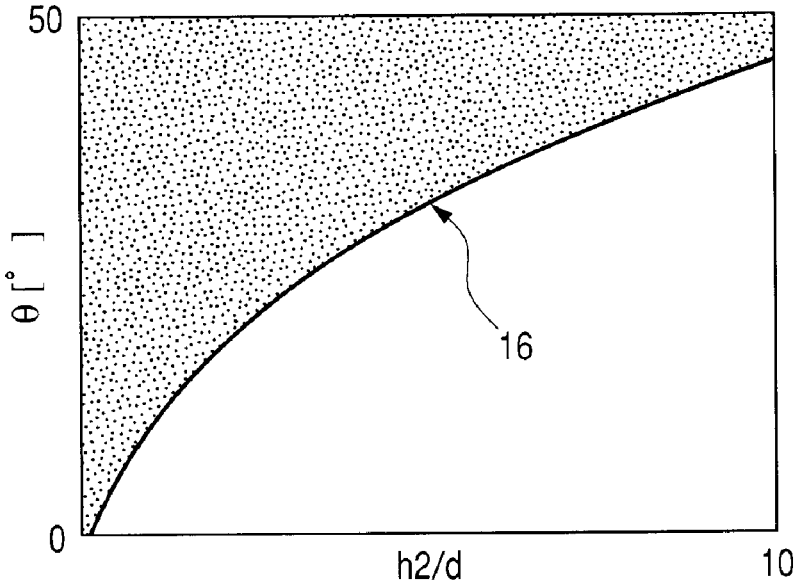
FIG. 6 is an explanatory view of critical points of the electron emission efficiency in the present invention.

FIG. 6 is a view schematically illustrating a region of critically improving the efficiency by using the relationship between the ratio of h2/*d* and the inclined angle θ. An approximate curve 16 in FIG. 6 is such an approximate curve of schematically illustrating critical points by using the relationship between the ratio of h2/*d* and the inclined angle θ. As illustrated in FIG. 6, when the ratio of h2/*d* becomes smaller, the inclined angle θ required to become a critical point becomes smaller. This result is due to a fact that when the ratio of h2/*d* becomes smaller, the flying distance f becomes a longer distance and the high efficiency is realized as mentioned above.

Figure 7:
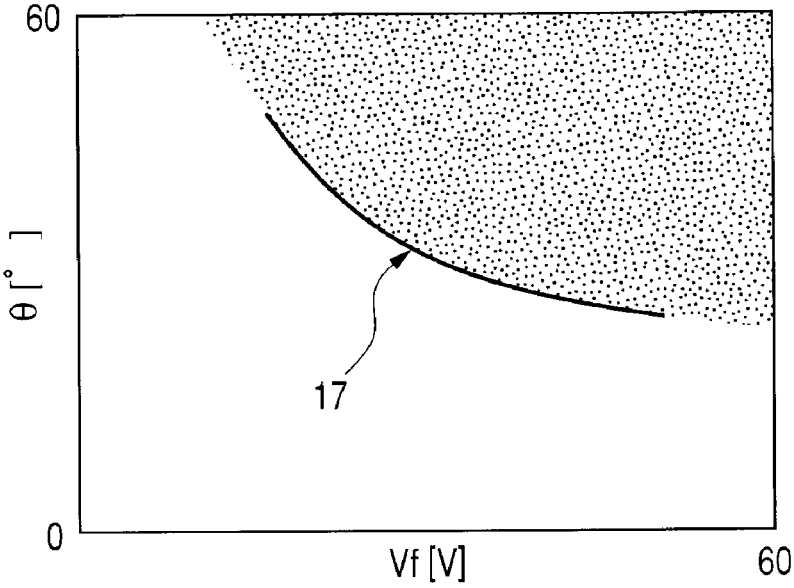
FIG. 7 is an explanatory view of critical points of the electron emission efficiency in the present invention.

FIG. 7 is a view schematically illustrating a region of critically improving the efficiency by using the relationship between the voltage Vf and the inclined angle θ. An approximate curve 17 in FIG. 7 is such an approximate curve of schematically illustrating critical points by using the relationship between the voltage Vf and the inclined angle θ. As illustrated in FIG. 7, when the voltage Vf becomes the higher voltage, the inclined angle θ required to become a critical point becomes smaller. This result is due to a fact that when the voltage Vf becomes the higher voltage, the flying distance f becomes a longer distance and the high efficiency is realized as mentioned above.

In FIGS. 6 and 7, a region where the inclined angle θ is in a range larger than the approximate curve 16 or the approximate curve 17, that is, a hatching region in each of FIGS. 6 and 7 indicates such a region where the efficiency becomes to reach a level of 100%.

The condition of the inclined angle θ in order that the efficiency becomes to reach a level of 100% can be expressed by the following expression (1) of using the ratio of h2/*d* and the voltage Vf.

$$\theta \geqq 15\times(h2/d)^{0.5}+(230\times Vf^{0.6}-35) \quad (1)$$

Here, a unit of the inclined angle θ is deg[°], units of the gap d and the height h2 are [nm] and a unit of the voltage Vf is [V].

The respective operations and effects of the present invention will be indicated.

In the present invention, some of the constitutions of the electron-emitting device which satisfies the above-mentioned expression (1) and can obtain an effect that the electron emission efficiency becomes to reach a level of 100% can be considered other than the present constitution. Examples of shapes will be indicated in FIGS. 8A, 8B and 8C, FIG. 9, FIGS. 10A and 10B and FIGS. 11A and 11B.

Figure 8A:
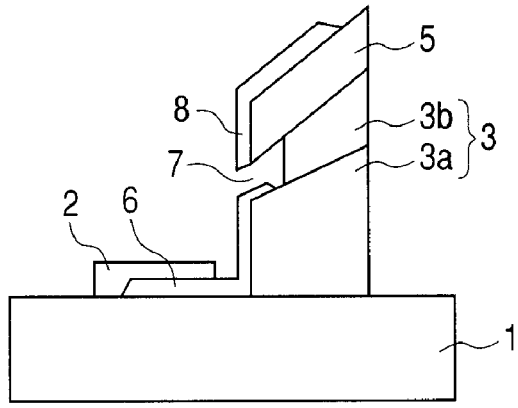
FIGS. 8A, 8B and 8C are views illustrating application examples of the electron-emitting device in the present invention.
Figure 8B:
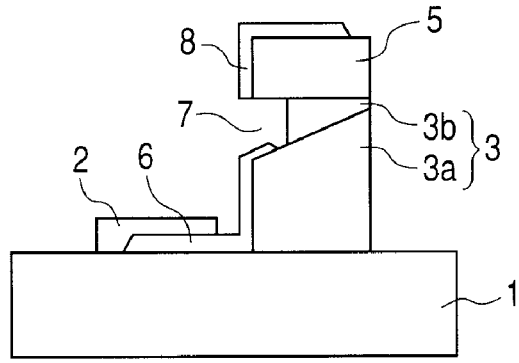
Figure 8C:
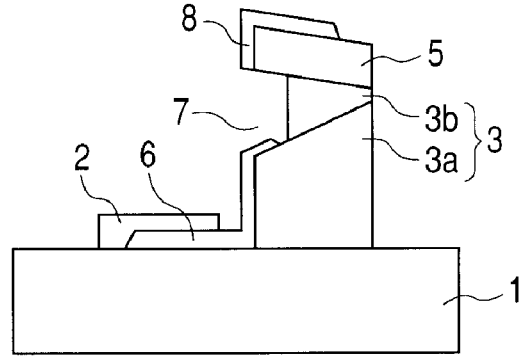

As indicated in FIGS. 8A to 8C, since the influence of the high-potential surface 27 in the concave portion 7 to efficiency is small as compared with the low-potential surface 28, the high-potential surface 27 may not be parallel to the incline of the low-potential surface 28. Although this constitution can obtain the similar effect to that of the basic constitution of the present invention, it is more preferable that also the high-potential surface 27 more inclines upward when it is more deeply advanced to the inside from the gateway because an electron emitting position can be formed on a location near the gateway.

Figure 9:
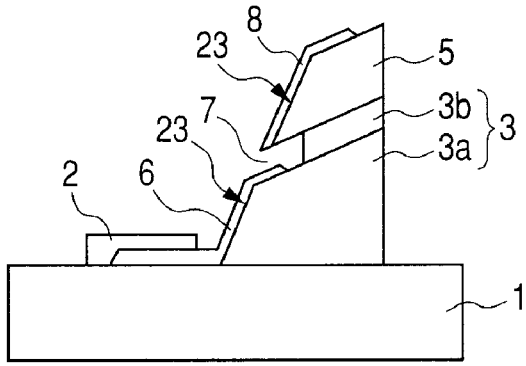
FIG. 9 is a view illustrating an application example of the electron-emitting device in the present invention.

As illustrated in FIG. 9, a side surface 23 after fabricating the gate 5 and the insulating layer 3*a* may be inclined. This constitution can obtain the similar effect to that of the basic constitution of the present invention.

Figure 10A:
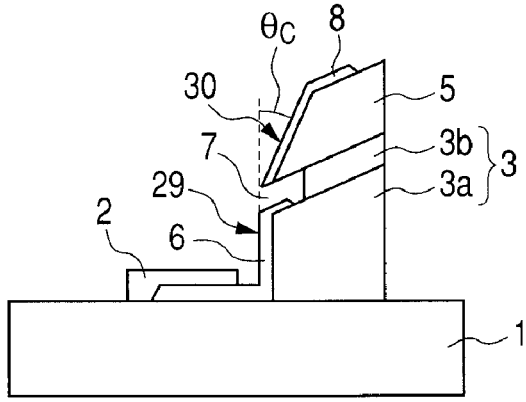
FIGS. 10A and 10B are views illustrating application examples of the electron-emitting device in the present invention.
Figure 10B:
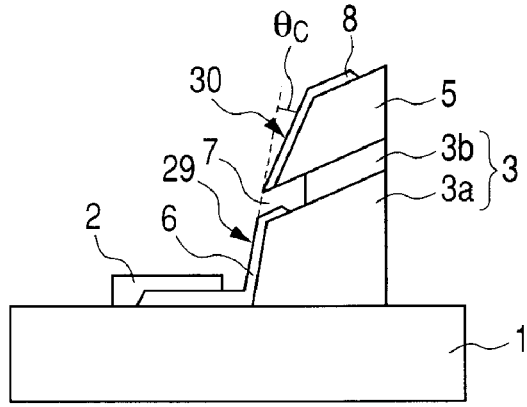

As illustrated in FIGS. 10A and 10B, when a side surface of the gate 5 after fabricating the gate 5 more extends to the upward, the side surface may more recede. As in FIGS. 10A and 10*b*, an angle formed between an extended line of a line segment connected with the end of the concave portion 7 and the side surface 30 of the high-potential surface is assumed as an inclined angle $\theta_C$. Although the inclined angle $\theta_C$ does not have so enough effect as that of the height h2, since the electrons become harder to be collided with the high-potential side structure when the inclined angle $\theta_C$ becomes a larger angle, the high efficiency is realized.

Figure 11A:
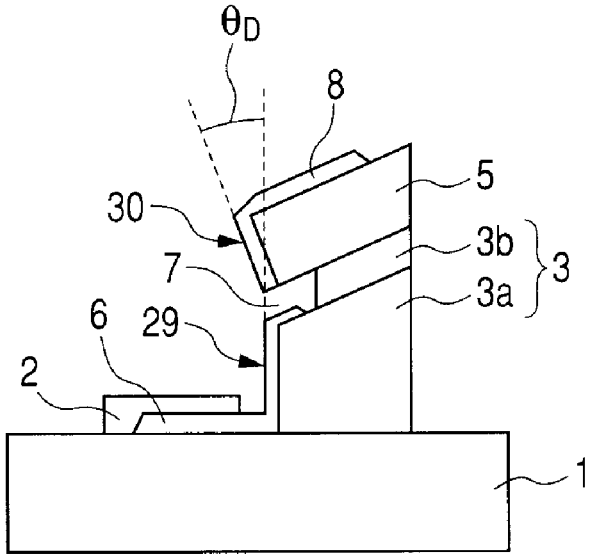
FIGS. 11A and 11B are plan views illustrating basic constitutional parts of other electron-emitting devices in the present invention.
Figure 11B:
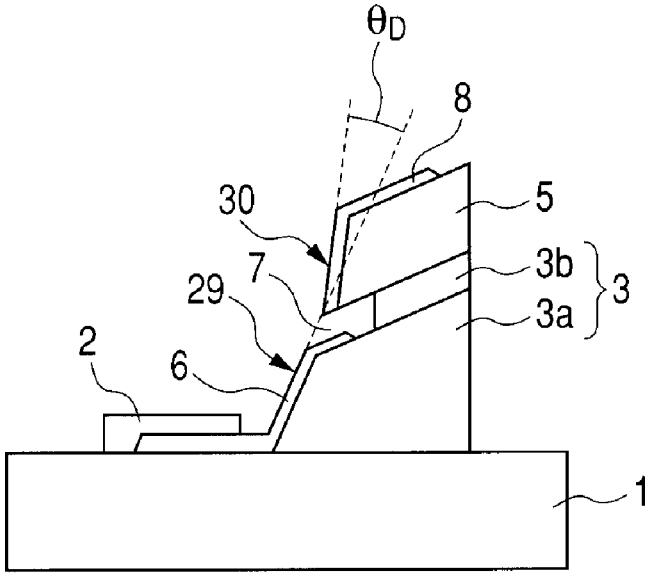

As illustrated in FIGS. 11A and 11B, in a range where an effect of the present invention can be obtained, when a side surface of the gate 5 after fabricating the gate 5 more extends to the upward, the side surface may more slightly protrude. As in FIGS. 11A and 11*b*, an angle formed between an extended line of a line segment connected with the end of the concave portion 7 and the side surface 30 of the high-potential surface is assumed as an inclined angle $\theta_D$. It is preferable that the inclined angle $\theta_D$ is a small angle from the above-mentioned reason and it is more preferable that the inclined angle $\theta_D$ is equal to or less than 5°.

Next, a manufacturing method of the electron-emitting device according to the present invention will be described.

FIGS. 12A, 12B, 12C, 12D and 12E are schematic views sequentially indicating manufacturing processes of the electron-emitting device illustrated in FIGS. 1A and 1B.

The substrate 1 is such a substrate which mechanically supports the device, and a silica glass, a glass from which the contained amount of impurities such as Na and the like are reduced, a soda lime glass and a silicon substrate are preferably used for the substrate 1. It is desirable as the function of the substrate 1 to be able not only to have high mechanical intensity but also to withstand a dry-etching process, a wet-etching process, and alkali or acid such as a liquid developer and the like. Moreover, in a case that the substrate 1 is used as an integrated unit such as a display panel, it is desirable for the substrate 1 to have a small thermal expansion difference for the deposition material or another laminating member. In addition, it is desirable as the substrate 1 to use a material characterized in that an alkaline element or the like from the inside of a glass is difficult to be dispersed in the course of a thermal process.

(Process 1)

Figure 12A:
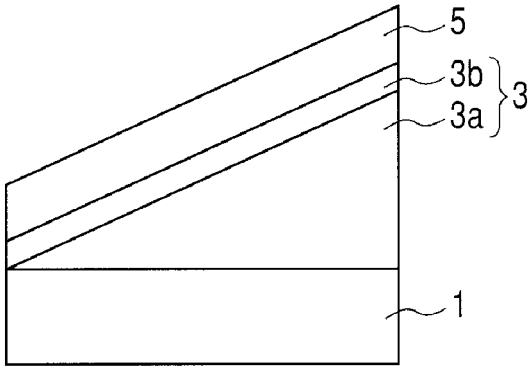
FIGS. 12A, 12B, 12C, 12D and 12E are views illustrating processes of a manufacturing method of the electron-emitting device in the present invention.

First, as illustrated in FIG. 12A, the insulating layers 3*a* and 3*b* are laminated on the substrate 1. At this time, an upper surface of the insulating layer 3*a* is processed into an inclined face inclined to a surface of the substrate 1 by a sandblasting method or the like. Then, the insulating layer 3*b* and the gate 5 are laminated. As to an inclined face forming method, the inclined face can be also formed by, for example, a processing method such as an etching method or the like or a forming method according to the multilayer structure of insulating layers.

The insulating layer 3*a* is an insulated film consisted of the material excellent in processibility, for example, it is such as SiN ($Si_xN_y$) or $SiO_2$. As to a forming method, the insulating layer 3*a* is formed by the general vacuum deposition method such as a sputtering method or the like, a CVD (Chemical Vapor Deposition) method or a vacuum vapor deposition method. The thickness of the insulating layer 3*a* is set to be in a range of several nanometers (nm) to several tens micrometers (μm). Preferably, the thickness is selected from such a range of several tens nanometers (nm) to several hundreds nanometers (nm).

The insulating layer 3*b* is an insulated film consisted of the material excellent in processibility similar to a case of the insulating layer 3*a*, for example, it is such as SiN ($Si_xN_y$) or $SiO_2$. As to a forming method, the insulating layer 3*b* is formed by a general vacuum deposition method, for example, the CVD method, the vacuum vapor deposition method or the sputtering method. The thickness of the insulating layer 3*b* is set to be in a range of 5 nm to 500 nm. Preferably, the thickness is selected from such a range of 5 nm to 50 nm. After laminating the insulating layers 3*a* and 3*b*, since the concave portion 7 has to be formed, it has to be set to have the different etching amount for the etching for a gap between the insulating layer 3*a* and the insulating layer 3*b*. Preferably, as a selection ratio, a ratio equal to or larger than 10 is desirable for the gap between the insulating layer 3*a* and the insulating layer 3*b*. If possible, it is more desirable to keep a ratio equal to or larger than 50.

For example, $Si_xN_y$ is used for the insulating layer 3*a*. The insulating layer 3*b* is constituted by, for example, the insulating material such as $SiO_2$ or the like or can be constituted by a PSG (Phospho-Silicate Glass) film contains a high concentration phosphorus or a BSG (Boro-Silicate Glass) film contains a high concentration boron.

The gate 5, which is a conductive member, is formed by a general vacuum deposition technology such as a vacuum vapor deposition method, a sputtering method or the like.

Additionally, such the material having high heat conductivity and a high melting point is desirable. For example, the metal of Be, Mg, Ti, Zr, Hf, V, Nb, Ta, Mo, W, Al, Cu, Ni, Cr, Au, Pt, Pd or the like or the alloy material consisted of any of these metals is used. In addition, a carbide such as TiC, ZrC, HfC, TaC, SiC, WC or the like, a boride such as $HfB_2$, $ZrB_2$, $LaB_6$, $CeB_6$, $YB_4$, $GdB_4$ or the like, a nitride such as TiN, ZrN, HfN, TaN or the like or a semiconductor such as Si, Ge or the like is also used. Furthermore, an organic polymeric material, an amorphous carbon, graphite, a diamond-like carbon, a carbon and a carbon compound containing dispersed diamonds can be also arbitrarily selected.

The thickness of the gate 5 is set to be in a range of 5 nm to 500 nm. Preferably, the thickness is selected from such a range of 50 nm to 500 nm.

(Process 2)

Figure 12D:
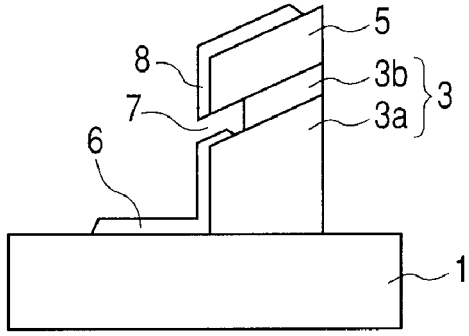
Figure 12B:
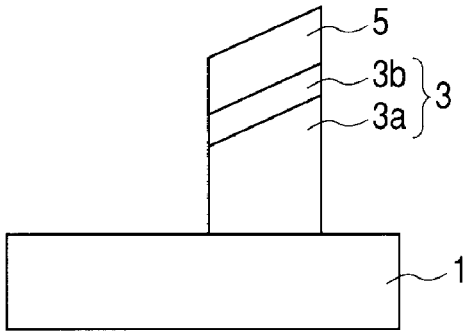

As illustrated in FIG. 12B, after performing the lamination, a resist pattern (not illustrated) is formed on the gate 5 by a photolithography technology, thereafter the gate 5, the insulating layer 3*b* and the insulating layer 3*a* are sequentially fabricated by using an etching method.

In this etching process, generally, an RIE (Reactive Ion Etching) which can execute a precise etching process of the material is used by transforming the etching gas in plasma and irradiating the plasma to the material.

As the processing gas at this time, in case of producing a fluoride as a target member to be processed, the fluorine-related gas such as $CF_4$, $CHF_3$ or $SF_6$ is selected. In case that a metal such as Si or Al forms a chloride by reacting with the chlorine, the chlorine-related gas such as $Cl_2$, $BCl_3$ or the like is selected. In order to adopt a selecting ratio with the resist, a hydrogen gas, an oxygen gas, an argon gas or the like is occasionally added to secure the smoothness of an etching surface or to increase the etching speed.

(Process 3)

Figure 12E:
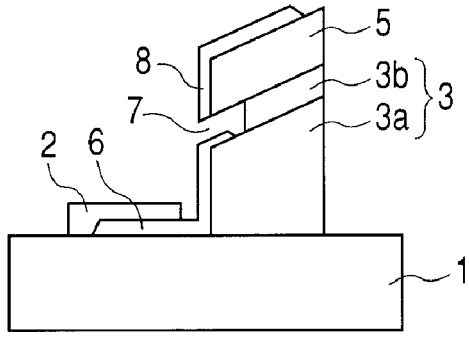
Figure 12C:
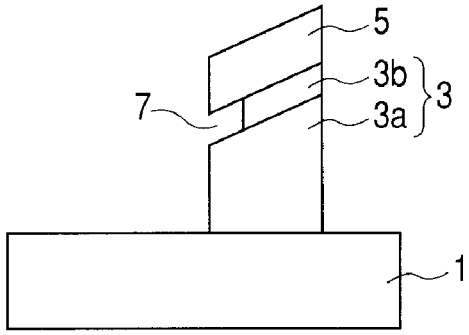

As illustrated in FIG. 12C, the concave portion 7 is formed on the insulating layer 3*b* by using the etching method.

In the etching method, for example, if the insulating layer 3*b* is a material consisted of $SiO_2$, a mixture solution commonly called a buffer hydrogen fluoride (BHF), which contains an ammonium fluoride and a hydrofluoric acid, is used. In addition, if the insulating layer 3*b* is a material consisted of $Si_xN_y$, the etching can be performed by using a thermal phosphoric acid etching liquid.

The distance (depth) of the concave portion 7 form a side surface of the insulating member 3 is deeply concerned with a leakage current after forming the device, and although a value of the leakage current becomes smaller when the distance (depth) is formed to become deeper, if the distance is formed to become too deep, since a problem that the gate 5 is deformed occurs, the distance is formed within a range of about 30 nm to 200 nm.

(Process 4)

As illustrated in FIG. 12D, the cathode 6 is adhered to the insulating layer 3*a* and the protruding portion 8 equivalent to the cathode 6 is adhered to the gate 5.

It is enough if the protruding portion 8, which has the conductivity, is the material capable of realizing the field emission, and this material, which generally has a high-melting point equal to or higher than 2000° C., is such a material of which the work function is in an energy level equal to or less than 5 eV. For this material, the material hardly capable of forming a chemical reaction layer such as an oxide or the like or easily capable of removing the reaction layer is preferable. As this material, for example, the metal of Hf, V, Nb, Ta, Mo, W, Au, Pt, Pd or the like or the alloy material consisted of any of these metals, a carbide such as TiC, ZrC, HfC, TaC, SiC, WC or the like or a boride such as $HfB_2$, $ZrB_2$, $LaB_6$, $CeB_6$, $YB_4$, $GdB_4$ or the like is used. In addition, a nitride such as TiN, ZrN, HfN, TaN or the like, an amorphous carbon, graphite, a diamond-like carbon, a carbon and a carbon compound containing dispersed diamonds can be enumerated.

As a forming method of the cathode 6 and the protruding portion 8, these are formed by the general vacuum deposition technology such as a vacuum vapor deposition method, a sputtering method or the like. As mentioned above, in the present invention, it is required to execute a forming process by controlling a vapor angle, a deposition time, the temperature when executing a forming process and the degree of vacuum when executing the forming process such that a cathode shape becomes the most suitable shape in order to extract electrons efficiently.

(Process 5)

As illustrated in FIG. 12E, the electrode 2 is formed in order to keep the electrical conduction with the cathode 6.

This electrode 2, which has the conductivity similar to the cathode 6, is formed by the general vacuum deposition technology such as a vacuum vapor deposition method, a sputtering method or the like and the photolithography technology. As the material of the electrode 2, for example, the metal of Be, Mg, Ti, Zr, Hf, V, Nb, Ta, Mo, W, Al, Cu, Ni, Cr, Au, Pt, Pd or the like or the alloy material consisted of any of these metals is used. In addition, a carbide such as TiC, ZrC, HfC, TaC, SiC, WC or the like, a boride such as $HfB_2$, $ZrB_2$, $LaB_6$, $CeB_6$, $YB_4$, $GdB_4$ or the like, a nitride such as TiN, ZrN, HfN or the like is also used. Furthermore, the material of the electrode 2 is arbitrarily selected from a semiconductor such as Si, Ge or the like, an organic polymeric material, an amorphous carbon, graphite, a diamond-like carbon, a carbon and a carbon compound containing dispersed diamonds or the like.

The thickness of the electrode 2 is set to be in a range of several tens nanometers (nm) to several millimeters (mm). Preferably, the thickness is selected from such a range of several tens nanometers (nm) to several micrometers (μm).

Although the electrode 2 and the gate 5 may be formed by the same forming method or different forming methods, the thickness of the gate 5 is sometimes set to be in a range of the thinner thickness as compared with the electrode 2, and it desirable to use a low-resistive material.

Example 1

The electron-emitting device of the present invention was manufactured in accordance with processes indicated in FIGS. 13A, 13B, 13C, 13D and 13E.

As the substrate 1, a PD 200, which is a low-sodium glass, developed for a plasma display was used.

Figure 13A:
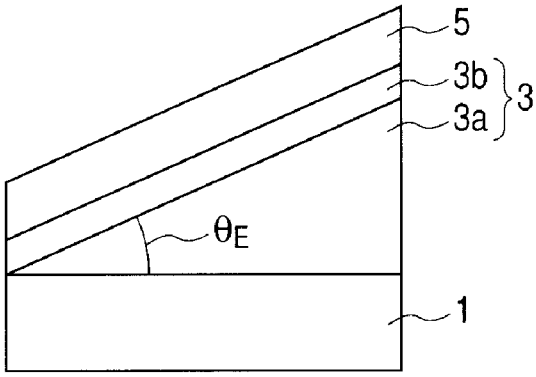
FIGS. 13A, 13B, 13C, 13D and 13E are views illustrating manufacturing processes of the electron-emitting device in an example of the present invention.

First, as illustrated in FIG. 13A, the insulating layer 3*a* was laminated on the substrate 1. At this time, an upper surface of the insulating layer 3*a* was processed to become an inclined plane for a horizontal plane of the substrate by a sandblasting method. Then, the insulating layer 3*b* and the gate 5 were laminated.

As the insulating layer 3*a*, a $SiN(Si_3N_4)$ film was formed by the sputtering method, and the thickness of this film was 500 nm. An angle $\theta_E$ of the upper surface for the horizontal plane of the substrate was formed to become about 20°.

As the insulating layer 3*b*, a $SiO_2$ film of which thickness is 30 nm was formed by the sputtering method.

As the gate 5, a TaN film of which thickness is 30 nm was formed by the sputtering method.

Figure 13D:
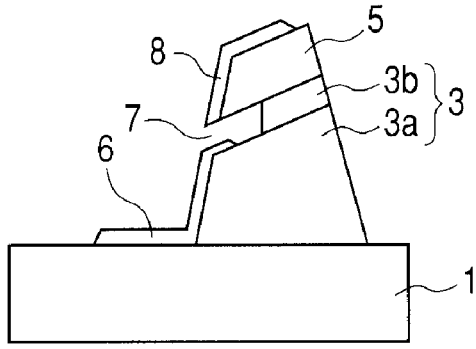
Figure 13B:
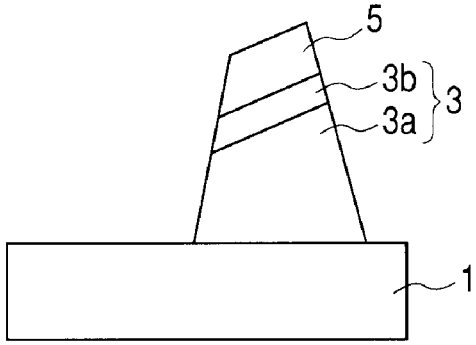

As illustrated in FIG. 13B, after performing the lamination, a resist pattern was formed on the gate 5 by the photolithography technology, thereafter the gate 5, the insulating layer 3*b* and the insulating layer 3*a* were sequentially fabricated by using a dry etching method.

As the processing gas at this time, since the material of producing the fluoride was selected for the insulating layers 3*a* and 3*b* and the gate 5, the $CF_4$-related gas was used. As a result of performing the RIE by using this gas, an angle of the side surfaces of the insulating layers 3*a* and 3*b* and the gate 5 of the device after the etching for a horizontal plane of the substrate was formed to become about 80°.

Figure 13E:
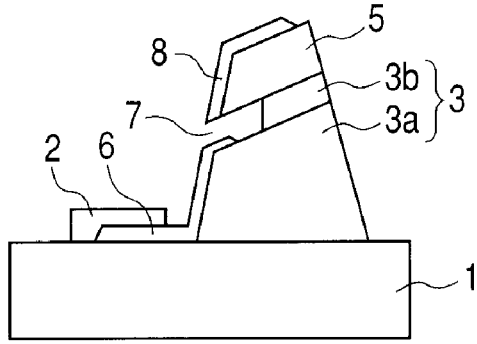
Figure 13C:
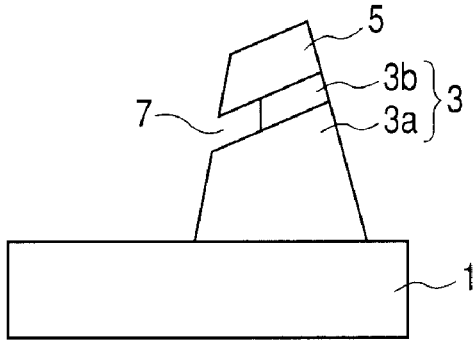

After stripping off the resist, as illustrated in FIG. 13C, the concave portion 7 was formed only at the insulating layer 3*b* by using an etching method such that the depth becomes about 70 nm by using the BHF.

Next, as illustrated in FIG. 13D, the cathode 6 was adhered to the insulating layer 3*a*, and the protruding portion 8, of which the material is same as that of the cathode 6, was adhered also to the gate 5. In the present example, as a deposition method, an EB (Electron Beam) vapor deposition method was used. In this forming method, the vapor deposition was performed such that the Mo enters from the inclined direction so as to be adhered to an upper surface and a side surface of the gate 5, a side surface of the insulating layer 3*a* after executing the RIE process and the inside of the concave portion 7.

Thereafter, a resist pattern was formed on the cathode 6 by the photolithography technology and then the cathode 6 was fabricated by the dry-etching method. As the processing gas at this time, since the Mo used as the material of the cathode 6 produces the fluoride, the $CF_4$-related gas was used.

As a result of the analysis by a cross-section TEM (Transmission Electron Microscope), a gap d of the concave portion 7 between the cathode 6 and the gate 5 in FIG. 2 was 10 nm.

Next, as illustrated in FIG. 13E, a copper (Cu) film, of which thickness is 500 nm, was formed as the electrode 2 by the sputtering method.

Figure 14:
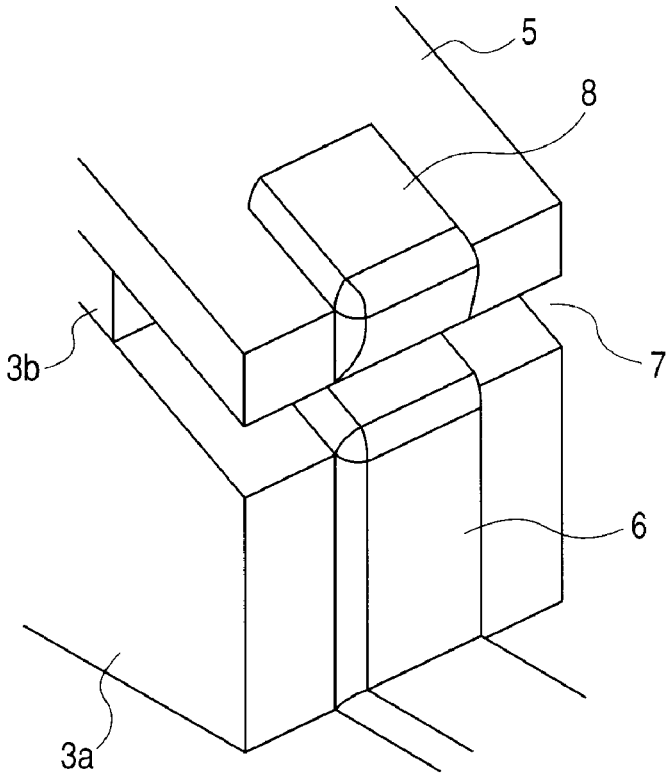
FIG. 14 is a perspective view of the electron-emitting device in the example of the present invention.

The device was formed by the above-mentioned method. A partial perspective view of the device is illustrated in FIG. 14.

The anode 20 and a power supply are connected with the obtained device as illustrated in FIG. 3, and the electron emission characteristic was evaluated.

As a result of evaluating the characteristic of the present constitution, a device, of which an average electron emission current Ie=1.5 μA and an average electron emission efficiency η=100% at the driving voltage Vf=26V, was obtained.

Figure 15:
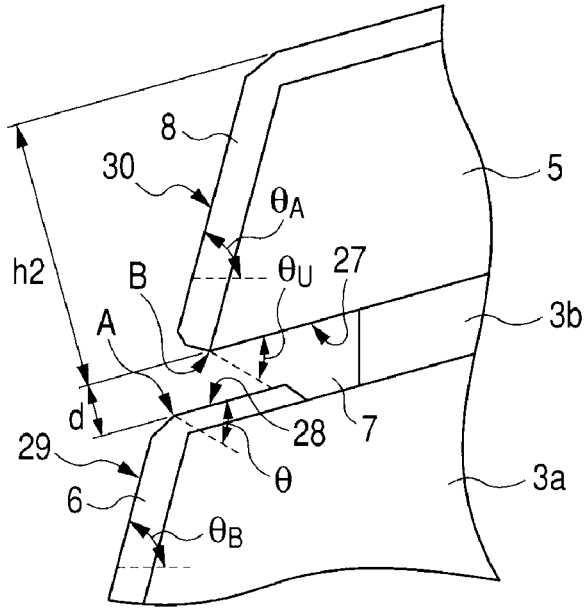
FIG. 15 is a cross-sectional view of the periphery of the concave portion of the electron-emitting device in the example of the present invention.

As a result of observing the periphery of the concave portion 7 of the device by the cross-section TEM, the shape as illustrated in FIG. 15 was confirmed. In FIG. 15, an angle $\theta_U$ indicates such an angle which is formed between a virtual plane to which the line segment AB serves as the normal line and the high-potential surface 27 in the concave portion 7. And, an angle $\theta_A$ indicates an angle of the side surface 30 at the high-potential side of an outer surface of the concave portion 7 to a horizontal plane of the substrate and an angle $\theta_B$ indicates an angle of the side surface 29 at the low-potential side of the outer surface of the concave portion 7 to a horizontal plane of the substrate respectively.

As a result of extracting values of the respective parameters, it was confirmed that $\theta=\theta_U=30°$, $\theta_A=80°$, $\theta_B=80$, h2=40 nm and d=10 nm.

When the above-mentioned parameters are assigned to the expression (1), the angle θ becomes equal to or larger than 28° (θ≧28°), and it was understood that the angle θ satisfies the expression (1) in the device of the present invention.

The following investigation was further conducted according to a manufacturing method and an evaluation method which are same as those in the above description.

The relationship with a condition of the angle θ, where the electron emission efficiency becomes 100% due to the variation of the Vf and the h2/*d*, was examined. The angle θ was varied every angle of 5°.

Figure 19A:
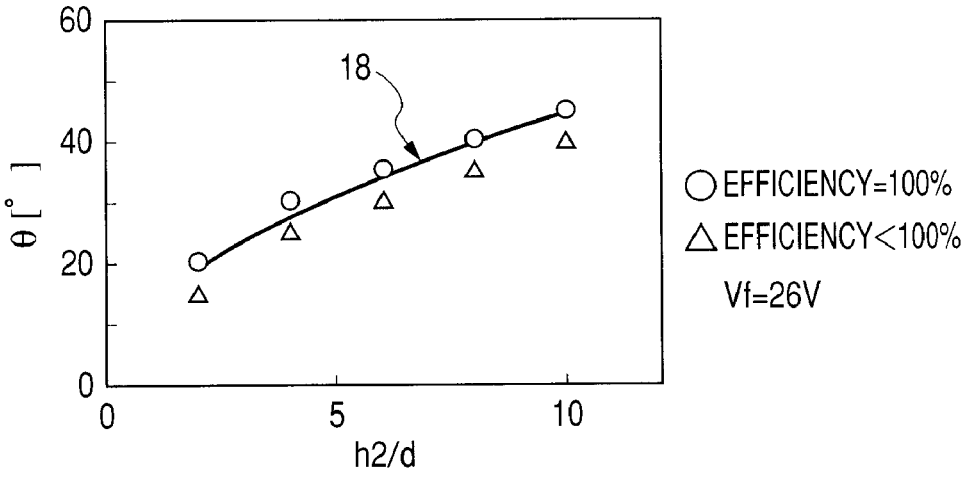
FIGS. 19A and 19B are views indicating the relationship between a ratio of h2/*d*, an angle θ and the electron emission efficiency of the electron-emitting device in the example of the present invention.
Figure 19B:
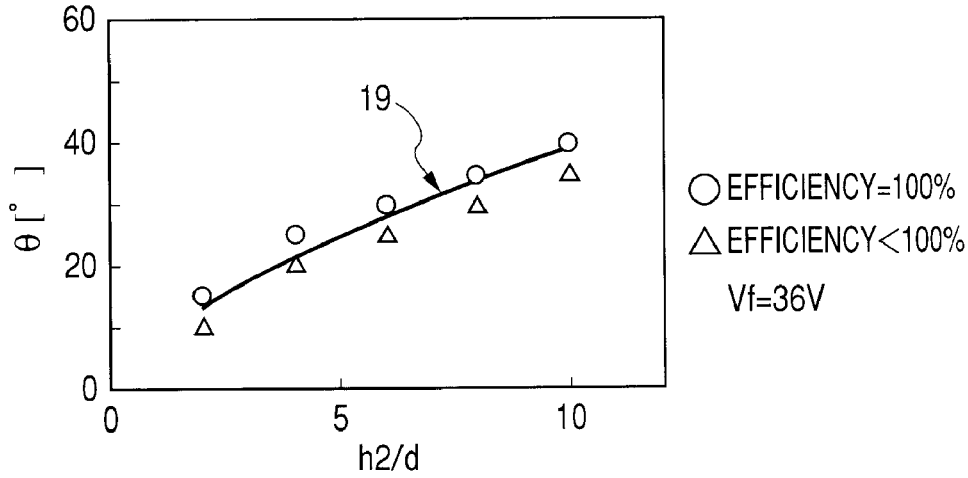

In FIGS. 19A and 19B, critical points of the angle θ, where the electron emission efficiency becomes 100% when the h2/*d* is varied, was indicated with the condition of two kinds of the voltage (26V and 36V). With respect to the variation of h2/*d*, specifically, the height h2 is varied at 20 nm intervals within a range of 20 nm to 100 nm while maintaining to fix the gap d as d=10 nm. In FIG. 19A, critical points when the voltage Vf=26V were indicated. In addition, in FIG. 19B, critical points when the voltage Vf=36V were indicated. An approximate curve 18 in FIG. 19A is such an approximate curve of plotting critical points of the angle θ when the voltage Vf=26V by using the expression (1). Similarly, an approximate curve 19 in FIG. 19B is such an approximate curve of plotting critical points of the angle θ when the voltage Vf=36V. Marks "○" in the respective views correspond to the condition of obtained such the efficiency, which is equal to 100%, and marks "Δ" correspond to the condition of resulted in such the efficiency, which is less than 100%.

Figure 20:
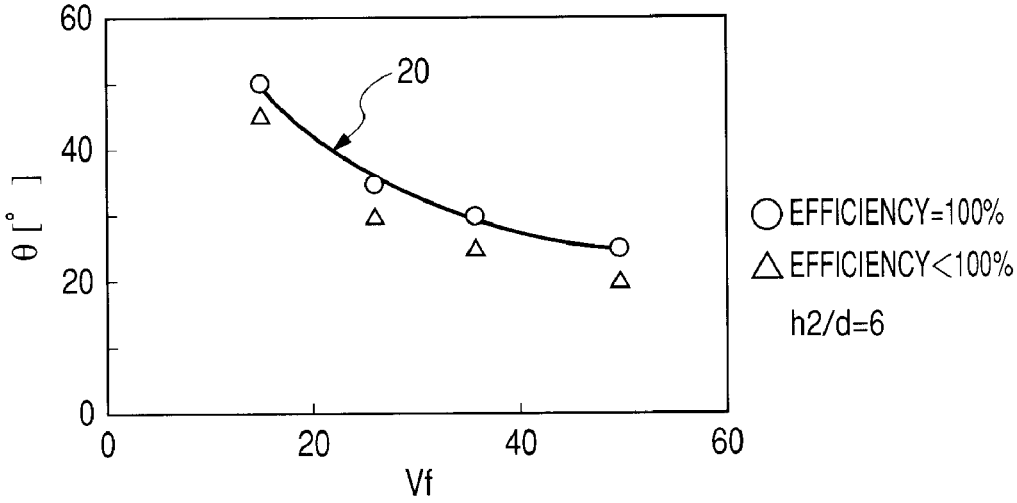
FIG. 20 is a view indicating the relationship between a voltage Vf, the angle θ and the electron emission efficiency of the electron-emitting device in the example of the present invention.

The condition of attained such the electron emission efficiency, which becomes equal to 100% when the voltage Vf was varied, was further examined. The voltage Vf was varied to become 15V, 26V, 36V and 50V. In FIG. 20, critical points of the angle θ, where the efficiency becomes 100% when the voltage Vf was varied, was indicated. An approximate curve 20 is such an approximate curve of plotting critical points of the angle θ when the voltage Vf is varied (h2/*d*=6) by using the expression (1). Similar to FIGS. 19A and 19B, marks "○" in the view correspond to the condition of obtained such the efficiency, which is equal to 100%, and marks "Δ" correspond to the condition of resulted in such the efficiency, which is less than 100%.

Comparative Example 1

The electron-emitting device was manufactured in accordance with processes indicated in FIGS. 21A, 21B, 21C, 21D, 21E and 21F and FIGS. 22A, 22B and 22C.

Figure 21A:
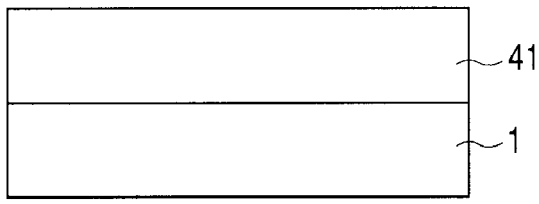
FIGS. 21A, 21B, 21C, 21D, 21E and 21F are views illustrating manufacturing processes of the electron-emitting device in the comparative example of the present invention.

First, an insulating layer 41 consisted of AlN, of which thickness is 300 μm, was laminated on the substrate 1 as illustrated in FIG. 21A.

Figure 21D:
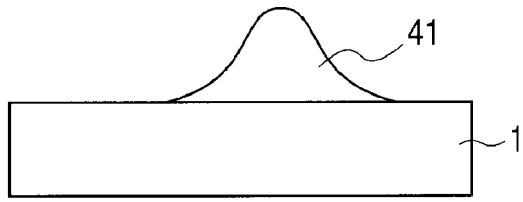
Figure 21B:
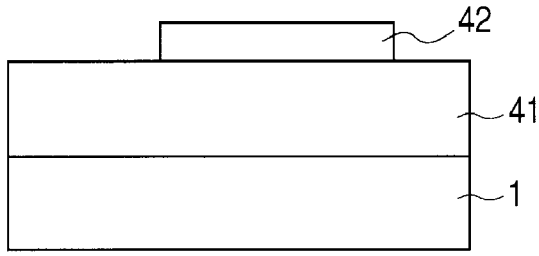
Figure 21E:
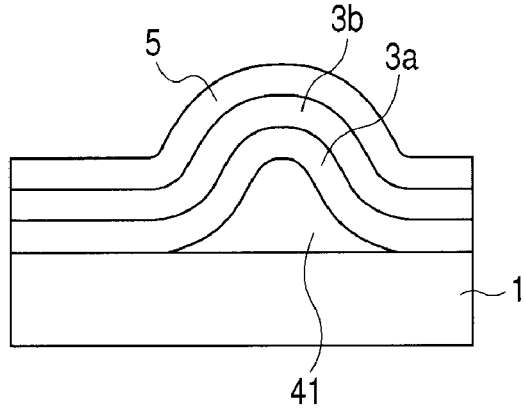
Figure 21C:
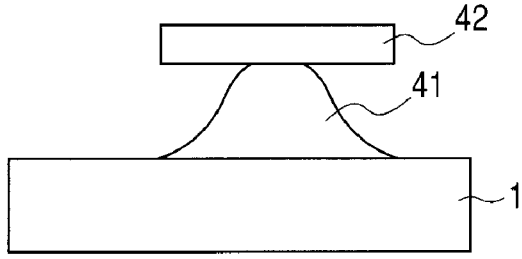
Figure 21F:
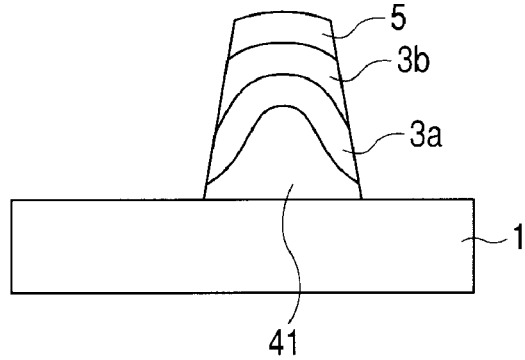

Next, a resist pattern 42 was formed on the insulating layer 41 by the photolithography technology after laminating the insulating layer as illustrated in FIG. 21B, and the insulating layer 41 was processed by using a wet-etching method and an inclined surface was formed as illustrated in FIG. 21C.

Thereafter, as illustrated in FIG. 21D, the resist pattern 42 was stripped off and then an etching by using the BHF (hydrofluoric acid etching) is performed. Additionally, the insulating layer 3*a*, the insulating layer 3*b* and the gate 5 were laminated as illustrated in FIG. 21E. The materials of respective layers are same as those in the example 1. After the lamination, a resist pattern was formed on the gate 5 by the photolithography technology, and then the gate 5, the insulating layer 3*b* and the insulating layer 3*a* were sequentially fabricated by using a dry-etching method.

Figure 22A:
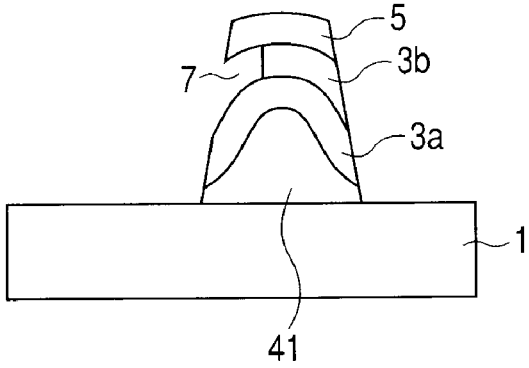
FIGS. 22A, 22B and 22C are views illustrating the manufacturing processes of the electron-emitting device in the comparative example of the present invention.

After stripping off the resist pattern 41, (FIG. 21F), the concave portion 7 was formed at only the insulating layer 3*b* by using the etching method such that the depth becomes 70 nm by using the BHF as illustrated in FIG. 22A.

Figure 22B:
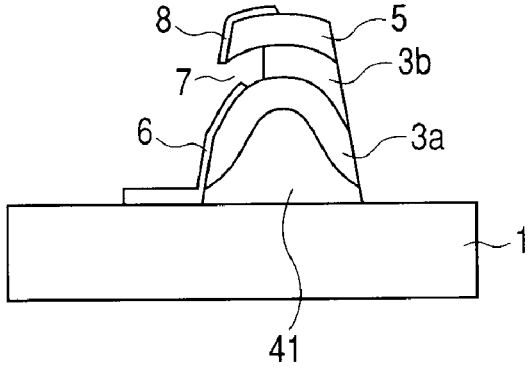

As illustrated in FIG. 22B, the cathode 6 consisted of the molybdenum (Mo) serving as the material was adhered to the insulating layer 3*a* by using the EB vapor deposition method. At this time, the protruding portion 8 consisted of the material same as that of the cathode 6 was also adhered on the gate 5. In this forming method, the vapor deposition was performed such that the Mo enters from the inclined direction so as to be adhered to an upper surface and a side surface of the gate 5, a side surface of the insulating layer 3*a* after executing the RIE process and the inside of the concave portion 7. The condition at this time was set to become same as that in the example 1.

Figure 22C:
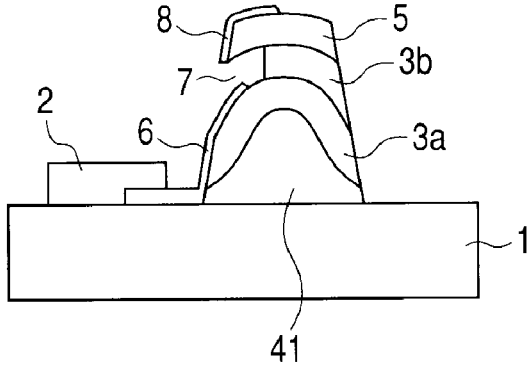

Next, the Cu, of which thickness is 500 nm, was laminated by the sputtering method and the electrode 2 was formed as illustrated in FIG. 22C.

After forming the device by the above-mentioned method, the electron emission characteristic was evaluated under the constitution illustrated in FIG. 3. As a result of the evaluation, the average electron emission current Ie was equal to 1.5 μA and the electron emission efficiency η was equal to 20.1% at the driving voltage Vf=26V.

As a result of observing the periphery of the concave portion of the device by the cross section TEM, a shape as in FIG. 15 was observed similar to a case in the example 1. As a result of extracting values of the respective parameters, it was confirmed that $\theta=\theta_U=5°$, $\theta_A=60°$, $\theta_B=80°$, h2=40 nm and d=10 nm, and it was understood that the angle θ did not satisfy the expression (1).

The investigation was further conducted by varying the angle θ ($=\theta_U$) to become 15° and 25° according to a manufacturing method and an evaluation method same as those in the above description. As a result of the investigation, the electron emission efficiencies are respectively 21.3% at the angle of θ=15° and 22.2% at the angle of θ=25°, and the electron emission efficiency is more improved when the angle θ becomes larger, however the efficiency did not reach 100%.

Comparative Example 2

Figure 16:
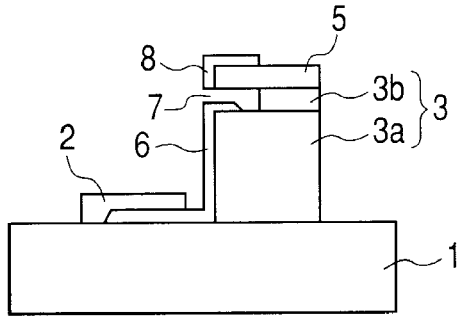
FIG. 16 is a view illustrating the constitution of an electron-emitting device in a comparative example of the present invention.

An electron-emitting device constituted as illustrated in FIG. 16 was manufactured.

First, the insulating layer 3*a* was laminated on the substrate 1 similar to the example 1, and the insulating layer 3*b* and the gate 5 were sequentially laminated while maintaining that the upper surface is not processed into the inclined surface.

Figure 17:
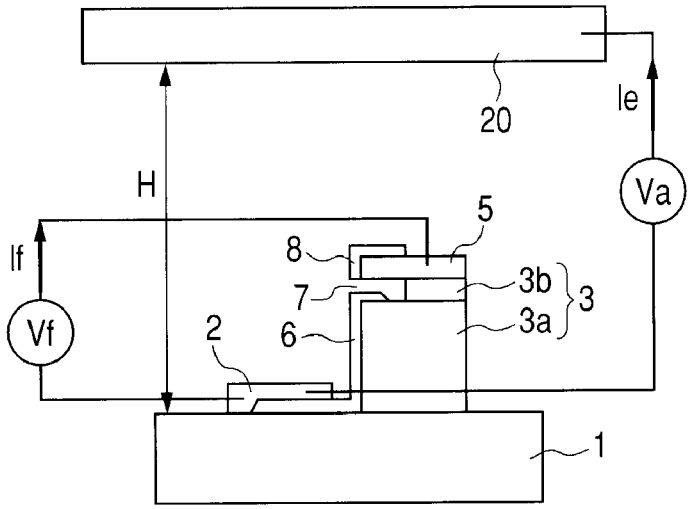
FIG. 17 is a view illustrating the constitution of an electron beam apparatus in the comparative example of the present invention.

Thereafter, the electron-emitting device was formed by the method similar to the processes in the example 1 indicated in FIGS. 12B to 12E, and the electron emission characteristic was evaluated under the constitution illustrated in FIG. 17. As a result of the evaluation, the average electron emission current Ie was equal to 1.5 μA and the electron emission efficiency η was equal to 19.6% at the driving voltage Vf=26V.

Figure 18:
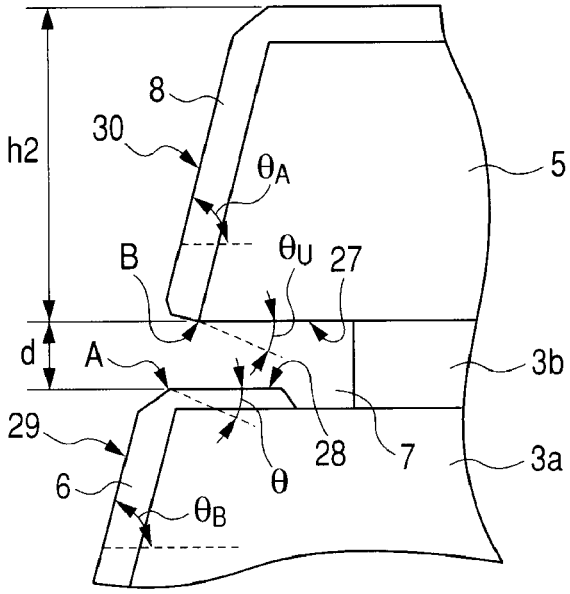
FIG. 18 is a cross-sectional view of the periphery of a concave portion of the electron-emitting device in the comparative example of the present invention.

As a result of observing the periphery of the concave portion of the device by the cross section TEM, a shape as in FIG. 18 was observed. As a result of extracting values of the respective parameters, it was confirmed that $\theta=\theta_U=0°$, $\theta_A=90°$, $\theta_B=90°$, h2=40 nm and d=10 nm.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2008-231026, filed Sep. 9, 2008, which is hereby incorporated by reference herein in its entirety.

What is claimed is:

1. An electron beam apparatus comprising:

an insulating member which has a concave portion on its surface;

a cathode which is positioned astride an outer surface of the insulating member and an inner surface of the concave portion;

a gate which is positioned opposite to the cathode on the outer surface of the insulating member; and an anode which is positioned opposite to the cathode so that the gate is disposed between the anode and the cathode, wherein an angle θ between a surface of a portion of the cathode which is positioned on the inner surface of the concave portion and a virtual plane of which a normal line is a line connecting respective aperture side ends of the cathode and the gate in a region of the concave portion that the cathode and the gate are mutually opposed satisfies an expression (1)

$$\theta \geqq 15\times(h2/d)^{0.5}+(230\times Vf^{-0.6}-35) \quad (0°<\theta<90°) \tag{1}$$

where d: a shortest distance between the cathode and the gate in the region of the concave portion that the cathode and the gate are mutually opposed [nm], h2: a height of a side member of the gate in a direction parallel with that of the shortest distance d [nm], and Vf: a driving voltage [V].

* * * * *